US005844584A

United States Patent [19]

Murphy, III et al.

[11] Patent Number: 5,844,584

[45] Date of Patent: Dec. 1, 1998

[54] PRINT HEAD STOP MECHANISM FOR A POSTAGE METER

[75] Inventors: Charles F. Murphy, III, Milford; Ralph A. Rapillo, Trumbull, both of Conn.

[73] Assignee: Pitney Bowes Inc., Stamford, Conn.

[21] Appl. No.: 775,820

[22] Filed: Dec. 31, 1996

[51] Int. Cl.[6] ..... B41J 25/308; B41J 11/20; B41J 13/10

[52] U.S. Cl. ..... 347/20; 347/8; 400/55; 400/645

[58] Field of Search ..... 347/4, 8, 44, 104, 347/20; 400/645, 645.1, 645.4, 647.1, 645.3, 174, 608, 613.3, 55

[56] References Cited

U.S. PATENT DOCUMENTS 5,623,876 4/1997 Murphy, III et al. ..... 347/33

5,646,653 7/1997 Fujioka et al. ..... 347/37

*Primary Examiner*—Benjamin R. Fuller
*Assistant Examiner*—Thien Tran
*Attorney, Agent, or Firm*—Steven J. Shapiro; Melvin J. Scolnick

[57] ABSTRACT

A postage meter for printing an indicia image on a print surface of a mailpiece includes a print head having a plurality of nozzles through which ink is ejected to print the indicia image on the print surface during relative movement between the print head and the mailpiece; a registration plate having a registration surface against which the mailpiece is registered to define an operative gap between the nozzles and the print surface, the registration plate having an opening therein to expose the print surface to the nozzles to permit printing of the indicia image on the print surface; and a stop mechanism connected to the print head so that at times when the print surface of the mailpiece extends through the opening the stop mechanism prevents contact between the print surface and the nozzles during printing of the indicia image.

6 Claims, 3 Drawing Sheets

PRINT HEAD STOP MECHANISM FOR A POSTAGE METER

BACKGROUND

The instant invention relates to a digital print head used in a metering device, and more particularly to a stop mechanism associated with the digital print head of the metering device which stop mechanism prevents damage to the digital print head caused by "puffy mailpieces" and ensures consistent good quality printing.

FIG. 1 shows a known arrangement of a digital print head 1 utilized in, for example, a postage meter for printing an indication of postage value (indicia) on a mailpiece (such as an envelope) 3. For simplicity in explanation, only the only structure of the postage meter being shown is print head 1 and its direction of movement and that structure which relates to the clamping of envelope 3 in the position where printing of the indicia image on a print surface 3*a* of envelope 3 occurs. The remaining structure of the postage meter is well known in the art and includes the apparatus for moving print head 1 back and forth in the horizontal "X" direction of FIG. 1 and the circuitry for synchronizing firing of the individual print head nozzles 4 with print head 1 movement. An example of the structure of the postage meter not shown herein can be found for example in copending application Ser. Nos. 08/579,504 filed Dec. 27, 1995, and 08/554,179 filed Nov. 6, 1995, which are each hereby incorporated by reference.

A typical operation of a conventional postage meter is as follows. Envelope 3 is either hand fed or automatically fed into the postage meter. A platen 5, upon which envelope 3 rests, raises upward to force envelope 3 against a registration plate 7 in a conventional manner. This ensures that the top surface of envelope 3 is accurately positioned against the bottom of registration plate 7. The accurate registration of envelope 3 is very important for operation of digital print head 1 because the row of nozzles 4 from which ink droplets are ejected onto the print surface of envelope 3 must be precisely positioned a fixed distance "A" from print surface 3*a* in order to ensure correct ink dot positioning and formation of a good quality image. Registration plate 7 has an opening 7*a* in a central portion thereof to expose print surface 3*a* in direct opposition to the row of nozzles 4. Accordingly, as print head 1 is moved in the X direction from the right to left in FIG. 1, a postage indicia image and an optional advertising slogan are printed on print surface 3*a* via the coordinated ejection of ink drops from nozzles 4 with the movement of print head 1.

In the event that print surface 3*a* remains in the position shown in FIG. 1, a satisfactory image is produced on envelope 3. However, sometimes an individual envelope 3 will "puff up" as shown in FIG. 2. That is, a central portion 3*b* of envelope 3 has bulged away from platen 5 such that the protruding portion 3*b* extends through the opening 7*a* of registration plate 7. This "puffy envelope" situation is often the result of air trapped in the envelope or simply is attributable to an envelope 3 that has been bent or crumpled prior to insertion into the postage meter. In any event, protruding portion 3*b* of envelope 3 now interferes with the movement of print head 1 along the printing direction X. As print head 1 moves from the right to the left in FIG. 2 and begins to eject drops of ink onto print surface 3*a,* the bottom surface 4*a* of the nozzles 4 (referred to as a nozzle plate) comes into contact with the print surface 3*a*. When this occurs, a readable indicia image cannot be produced since the ink will be smeared on print surface 3*a*. Furthermore, since the nozzle plate 4*a* has a special non-wetting coating thereon which helps to maintain the correct meniscus in each nozzle 4 to ensure that the proper size of ink drop is ejected from nozzles 4, it is highly possible that this coating can be damaged due to the abrasion which occurs between the print surface 3*a* of envelope 3 and nozzle plate 4*a*. If the puffy envelope situation is encountered often enough, the non-wetting coating can be damaged resulting in the inability of the print head 1 to produce the desired quality indicia image. Thus, print head 1 will have to be replaced.

Additionally, and as previously discussed, even if envelope 3 only protrudes into the opening 7*a* to a position were it does not contact nozzle plate 4*a,* degradation of the image produced on the print surface 3*a* is still likely to occur. Due to the criticality of dimension "A" between nozzle plate 4*a* and print surface 3*a*. A puffed envelope which projects into opening 7*a* but does not make contact with nozzle plate 4*a* will have a print surface 3*a* of protruding portion 3*b* which varies in its vertical distance from nozzle plate 4*a* as the print head 1 is moved to print. This variation in vertical distance between the print surface 3*a* of protruding portion 3*b* and nozzle plate 4*a* may result in inconsistent dot placement and an unsatisfactory printed image.

SUMMARY OF THE INVENTION

It is an object of the invention to provide a stop mechanism associated with a printing mechanism of a postage meter which prevents damage to the print head which may be caused by puffy mailpieces and which ensures consistent good quality printing.

This object is met by providing a postage meter for printing an indicia image on a print surface of a mailpiece, the postage meter including a print head having a plurality of nozzles through which ink is ejected to print the indicia image on the print surface during relative movement between the print head and the mailpiece; a registration plate having a registration surface against which the mailpiece is registered to define an operative gap between the nozzles and the print surface, the registration plate having an opening therein to expose the print surface to the nozzles to permit printing of the indicia image on the print surface; and a stop mechanism connected to the print head so that at times when the print surface of the mailpiece extends through the opening the stop mechanism prevents contact between the print surface and the nozzles during printing of the indicia image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 3:
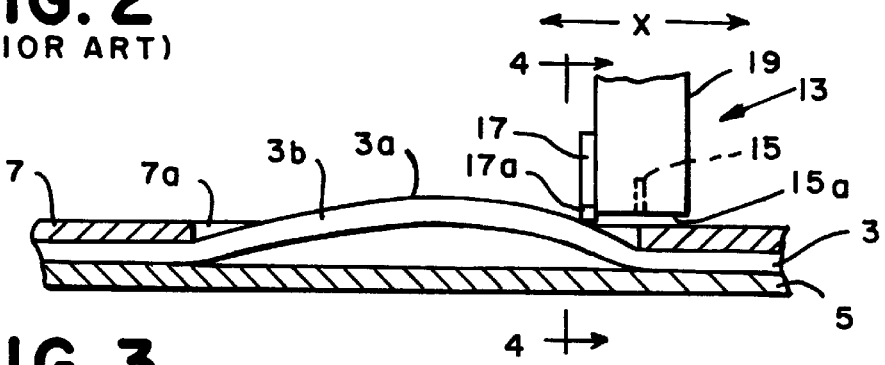
FIG. 3 shows a first embodiment of a postage meter with a first inventive stop mechanism.
Figure 4:
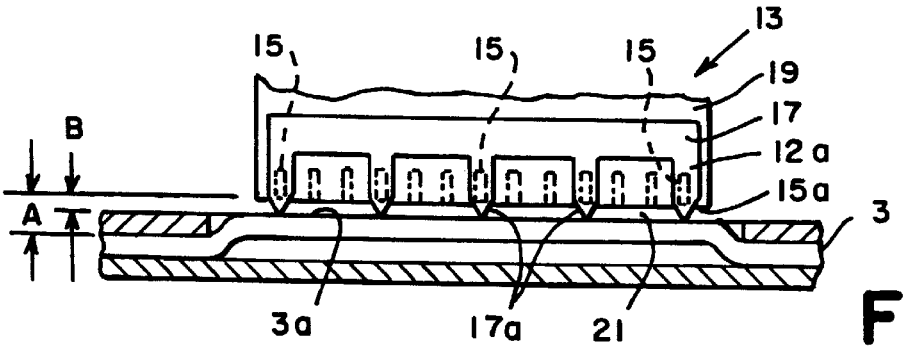
FIG. 4 shows a sectional view along line IV—IV of FIG. 3.

Referring to FIGS. 3 and 4, a print head 13 includes a row of nozzles 15 in a nozzle plate 15*a*. A stop mechanism 17 is fixedly attached to or formed as part of a housing portion 19 of print head 13. Stop mechanism 17 includes a plurality of pointed projections 17*a* which extend below nozzle plate 15*a*. Pointed projections 17*a* are each aligned on center with a corresponding one of nozzles 15 for a purpose to be discussed in more detail below.

In FIGS. 3 and 4, print head 13 is shown at the point where stop mechanism 17 first makes contact with projecting portion 3*b* of envelope 3. Thus, the tip of each pointed projection 17*a* contacts print surface 3*a* of envelope 3. As print head 13 moves from the right to left in FIG. 3 the pointed projections 17*a* push protruding portion 3*b* of envelope 3 downward and away from nozzle plate 15*a* to ensure that a space 21 always exists between the nozzle plate 15*a* and print surface 3*a* during printing of the indicia image. The pointed projections 17*a* therefore prevent contact between print surface 3*a* and nozzle plate 15*a* ensuring that any non wetting coating on the surface of nozzle plate 15*a* is not damaged during printing.

Each of pointed projections 17*a* are aligned on center with a corresponding nozzle 15 in order to permit multi-pass printing. That is, the print head of FIG. 3 prints while moving from right to left. It then returns to a home position by moving from left to right, during which movement no printing occurs. However, where multiple passes of the print head are required to produce the final indicia image, the print head is shifted, for example, by half of the distance between the individual nozzles so that on a second pass from the right to left (of FIG. 3) a new set of ink drops will be ejected in interlaced relationship to the first set of ink drops. If the pointed projections 17*a* are not disposed on center with the nozzles 15, they will, during the second printing pass, run over the ink dots printed during the first pass and smear the image since the ink deposited during the first pass will not have completely dried. Aligning the pointed projections 17*a* with the nozzles 15 precludes the smearing problem.

Figure 5:
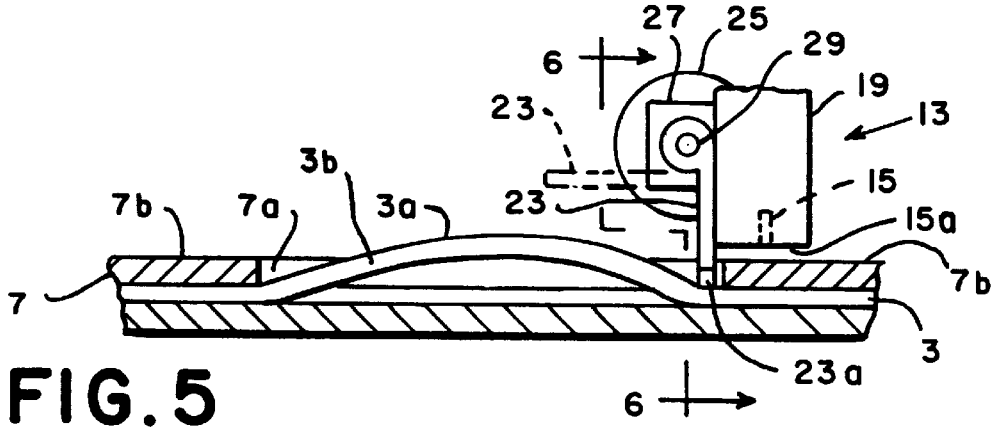
FIG. 5 shows a second embodiment of a postage meter with second inventive stop mechanism.
Figure 6:
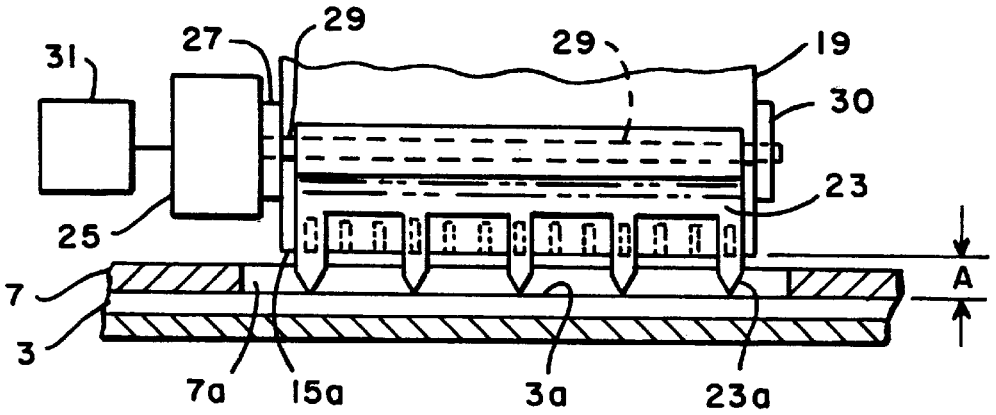
FIG. 6 shows a sectional view along line VI—VI of FIG. 5.

While the embodiment discussed above in connection with FIGS. 3 and 4 prevents contact between the envelope 3 and the nozzle plate 15*a*, the distance between the print surface 3*a* of envelope 3 and nozzle plate 15*a* is changed from dimension "A" to the dimension "B" as shown in FIG. 4. Depending the velocity of the drop and the velocity of print head 13 as it moves in the "X" direction, this decreased distance between print surface 3*a* and nozzle plate 15*a* can result in the printing of an image which is significantly degraded. Accordingly, FIGS. 5 and 6 set forth a second embodiment of the invention which not only prevents contact between the print surface 3*a* and the nozzle plate 15*a*, but ensures that the gap "A" between the nozzle plate 15*a* and the print surface 3*a* remains consistent during printing. In FIGS. 5 and 6, stop mechanism 23 is shown in its solid line operative position as extending into and through opening 7*a* of registration plate 7 so that its pointed projections 23*a* contact print surface 3*a* at a position aligned with the underside of registration plate 7. Thus, referring to FIG. 6, as print head 13 moves during printing from the right to left in FIG. 5, the pointed projections 23*a* encounter print surface 3*a* preventing contact between nozzle plate 15*a* and print surface 3*a* while also ensuring that print gap "A" remains constant.

While the above structure is very effective in resolving the printing problems previously discussed, stop mechanism 23 must be capable of being rotated from the solid line position of FIG. 5 to the dashed line position of FIG. 5 in order to permit print head 13 to return to a home maintenance position (not shown) which would, for example, be positioned further to the right in FIG. 5. If stop mechanism 23 is left in its solid line position, it will not clear opening 7*a* of registration plate 7. Accordingly, structure is needed to permit movement of stop mechanism 23 between the two positions shown in FIG. 5. The movement of stop mechanism 23 is provided by a solenoid 25 mounted to a bracket 27 which itself is fixedly mounted to print head housing 19. A rotatable shaft 29 extends from solenoid 25 and is mounted for rotation in bracket 27 and a corresponding bracket 30 fixed on the opposite side of housing 19. Stop mechanism 23 is fixedly mounted to shaft 29 to rotate therewith. FIG. 6 shows stop mechanism 23 in the downward position which occurs when solenoid 25 is activated by a microcontroller 31 of the postage meter. Microcontroller 31 could, for example, be the same microcontroller which is utilized in a conventional manner for controlling the movement and firing of print head 13. Alternatively, when microcontroller 31 deactivates solenoid 25 the return spring (not shown) of solenoid 25 rotates shaft 29 in the opposite direction moving stop mechanism 23 to the inoperative dashed line position of FIG. 5. In the inoperative position, print head 13 is allowed to freely move past the opening 7*a* for engagement with a conventional maintenance station. When the print head 13 is activated to print, microcontroller 31 activates solenoid 25 to rotate shaft 29 such that stop mechanism 23 moves from the dashed line position to the solid line position at the point where stop mechanism 23 has cleared a top surface 7*b* of registration plate 7 at the beginning of opening 7*a* during movement of print head 13 from right to left in FIG. 5. It is also noted that when stop mechanism 23 is in the operative position, it is forced against housing 19 in order to maintain a positive locked position of stop mechanism 23. This ensures that stop mechanism 23 effectively pushes down the protruding portion 3*b* of envelope 3 as printing occurs.

Figure 7:
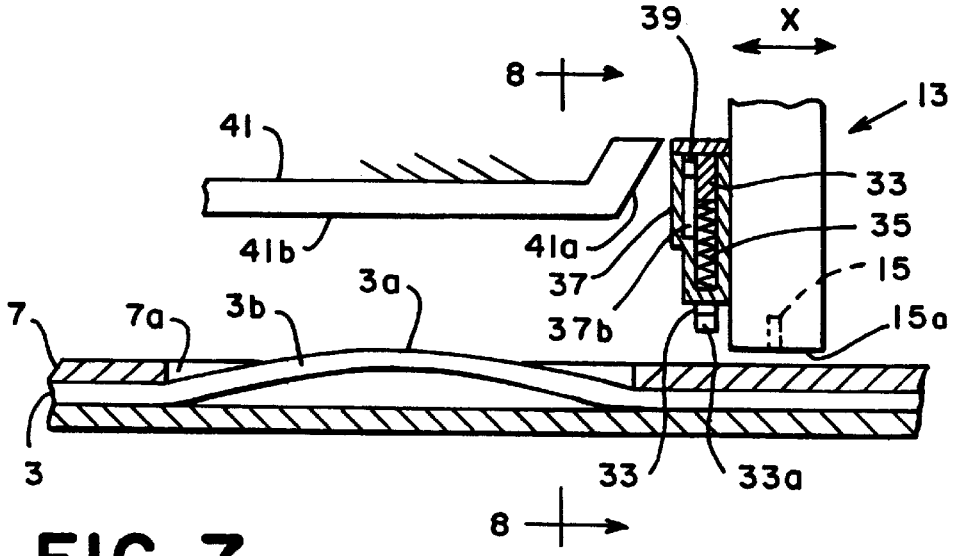
FIG. 7 shows a third embodiment of a postage meter with a third inventive stop mechanism.
Figure 8:
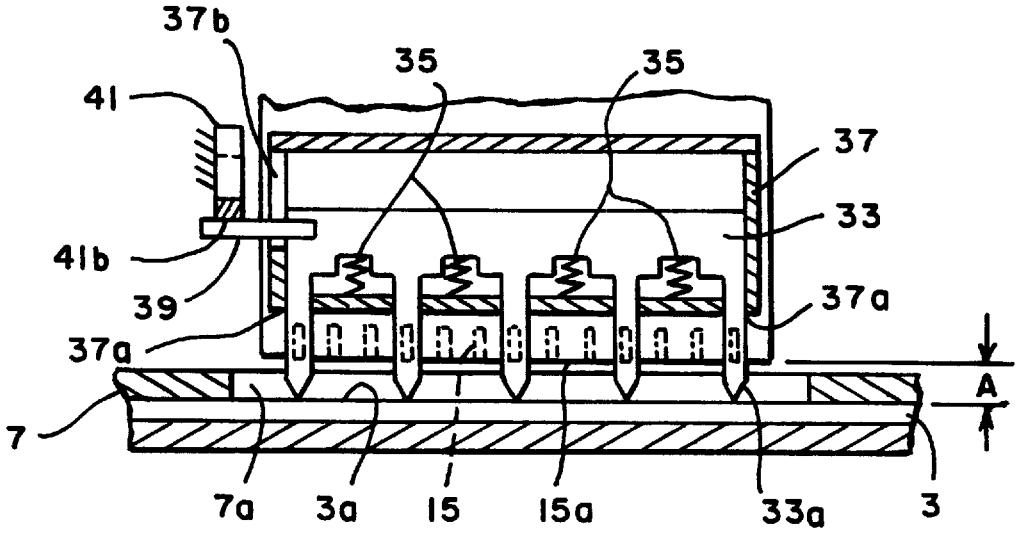
FIG. 8 shows a sectional view along line VIII—VIII of FIG. 7 with the print head in a position at the beginning of the registration plate opening.

FIGS. 7 and 8 show a third embodiment of the invention. In the embodiment of FIGS. 7 and 8, the movement of stop mechanism 33 between the operative and inoperative positions is self actuated by movement of print head 13. Stop mechanism 33 is mounted within a casing 37 to be slideable up and down therein and is biased upwardly in an inoperative position, as shown in FIG. 7, by a plurality of springs 35. Pointed projections 33*a* of stop mechanism 33 extend through corresponding openings 37*a* in casing 37. Stop mechanism 33 also includes an arm 39 cam follower which is fixedly attached thereto and extends through a slot 37*b* in casing 37. Thus, as shown in FIG. 7, arm 39 is positioned at the top of slot 37*b* and stop mechanism 33 is positioned at the top of casing 37 due to the force of springs 35. However, as print head 13 moves toward opening 7*a* of registration plate 7 to print on surface 3*a* of envelope 3, arm 39 will contact a cam 41 which is fixedly mounted within the mailing machine. Arm 39 first contacts a slanted surface 41*a* and slides downward therealong as print head 13 moves to the left in FIG. 7. When print head 13 has moved to the point where arm 39 is now beneath cam surface 41*b,* stop mechanism 33 has been lowered to its operative position against the force of springs 35, as shown in FIG. 8. At this point in time, pointed projections 33*a* contact printed surface 3*a* of envelope 3 and push against protruding portion 3*b* so that printing surface 3*a* becomes aligned with the bottom of registration plate 7. This prevents contact between surface 3*a* and nozzle plate 15*a,* and ensures that the gap "A" between nozzle plate 15*a* and printed surface 3*a* remains fixed during printing. As previously discussed, this configuration is considered to be very simple and effective because the movement of stop mechanism 33 is self-actuated by the normal printing movement of print head 13.

Figure 1:
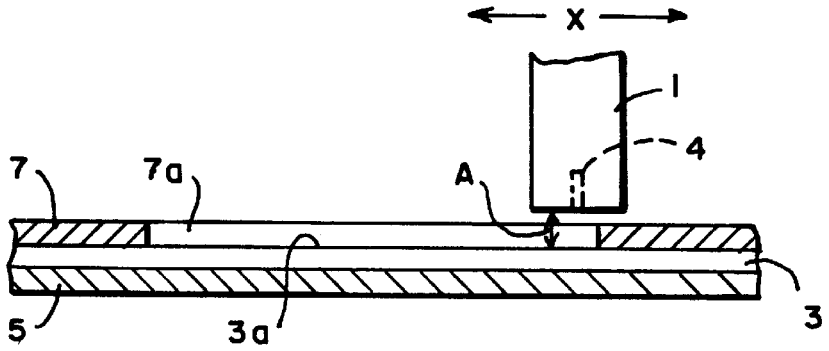
FIG. 1 (PRIOR ART)
FIG. 1 shows portions of the printing and registering mechanism of a conventional postage stage meter.
Figure 2:
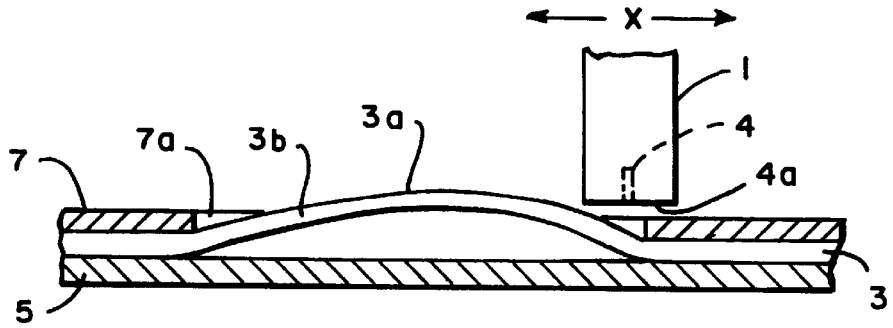
FIG. 2 (PRIOR ART)
FIG. 2 shows the postage meter of FIG. 1 with a puffy envelope registered therein.
Figure 9:
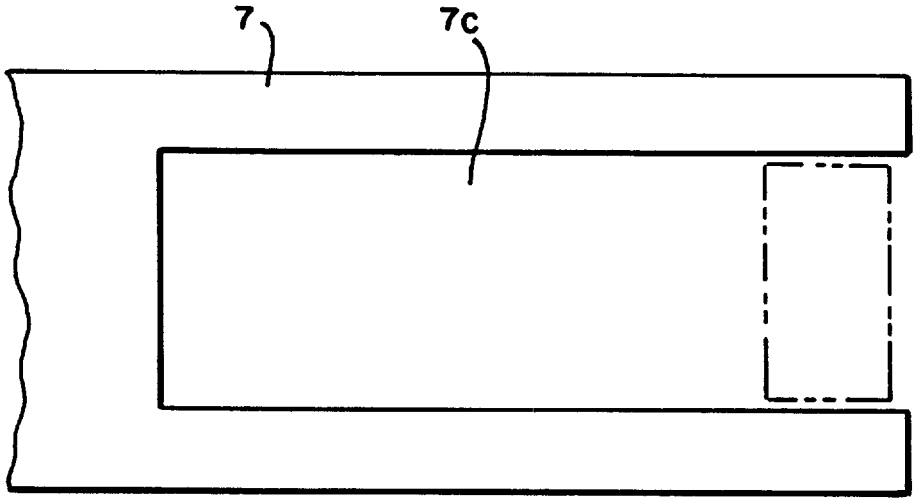
FIG. 9 shows a registration plate having a slot.

FIG. 9 shows a registration plate 7 having a slot 7*c* therein instead of opening 7*a*. Slot 7*b* would allow a fixed stop mechanism such, as that shown in FIGS. 3 and 4, to be used in lieu of the movable structures of FIGS. 5–8. That is, print head 13 of FIG. 2 can move from the right to the left into slot 7*c* to push down against the print surface 3*a* so that the distance between print surface 3*a* and the nozzle plate 15*a* could be maintained at the distance "A". This structure will work quite well, however, changes may be required at the maintenance station (not shown) of the printing mechanism in order to ensure that the nozzle plate 15*a* can be effectively wiped and purged.

While the preferred embodiments are described in connection with a postage meter, the instant invention can equally be applied to any printing mechanism which may encounter a "puffy document" situation. Moreover, while the print head is shown moving relative to a stationary mailpiece, it is also known to move the mailpiece relative to a stationary print head or to move both the mailpiece and the print head relative to each other. Furthermore, the stop mechanism can be other than the pointed projections shown. For example, a serrated edge could be used or a roller bar or even a plurality of star wheels in lieu of the pointed projections. Additionally, the stop mechanism can be connected directly to the print head or to a support structure for the print head itself.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. A postage meter for printing an indicia image on a print surface of a mailpiece, the postage meter comprising:

a print head having a plurality of nozzles through which ink is ejected to print the indicia image on the print surface during relative movement between the print head and the mailpiece;

a registration plate having a registration surface against which the mailpiece is registered to define an operative gap between the nozzles and the print surface, the registration plate having an opening therein to expose the print surface to the nozzles to permit printing of the indicia image on the print surface; and means, connected to the print head, for preventing contact between the print surface and the nozzles during printing of the indicia image at times when the print surface of the mailpiece extends through the opening, the means for preventing including a plurality of pointed projections which each extend below the nozzles and are aligned with a corresponding one of the nozzles and which during printing contact the print surface extending through the opening thereby preventing contact between the print surface extending through the opening and the nozzles.

2. A postage meter as recited in claim 1, wherein the opening is a slot having an open end, the print head and mailpiece move relative to each other such that the print head passes through the open end and into the slot during printing, and the means for preventing extends to approximately the registration surface of the registration plate so that during printing the means for preventing positions the print surface extending through the opening in proximate alignment with the registration surface thereby ensuring the operative gap between the nozzles and the print surface is not reduced during printing.

3. A postage meter for printing an indicia image on a print surface of a mailpiece, the postage meter comprising:

a print head having a plurality of nozzles through which ink is ejected to print the indicia image on the print surface during relative movement between the print head and the mailpiece;

a registration plate having a registration surface against which the mailpiece is registered to define an operative gap between the nozzles and the print surface, the registration plate having an opening therein to expose the print surface to the nozzles to permit printing of the indicia image on the print surface;

means, connected to the print head, for preventing contact between the print surface and the nozzles during printing of the indicia image to maintain the operative gap between the nozzles and the print surface at times when the print surface of the mailpiece extends at least into the opening; and means for moving the means for preventing between an operative position and an inoperative position such that during printing the means for preventing is in the operative position to align the print surface which extends at least into the opening with the registration surface and during non-printing the means for preventing is in the inoperative position to permit relative movement of the print head and opening past each other;

wherein the means for preventing comprises a plurality of pointed projections which each extend below the nozzles and are aligned with a corresponding one of the nozzles and which during printing contact the print surface extending through the opening to align the print surface extending through the opening with the registration surface thereby preventing contact between the print surface extending through the opening and the nozzles and preventing reduction of the operative gap during printing.

4. A postage meter as recited in claim 3, wherein the moving means includes a solenoid connected to the print head, a shaft mounted to the solenoid for rotation by the solenoid, and a microcontroller for actuating and deactuating the solenoid to rotate the shaft, and wherein the means for preventing is mounted on the shaft to rotate therewith such that upon actuation of the solenoid by the microcontroller the solenoid rotates the shaft so that the means for preventing is moved to one of the operative and inoperative positions and upon deactivation of the solenoid by the microcontroller the solenoid rotates the shaft so that the means for preventing is moved to an other of the operative and inoperative positions.

5. A postage meter as recited in claim 3, wherein at least the print head is moveable between a printing position and a non-printing position and the moving means is automatically actuated to move the means for preventing between the operative position and the inoperative position by movement of the print head between the printing and non-printing positions.

6. A postage meter as recited in claim 5, wherein the moving means includes a casing having a cavity therein which cavity is contiguous with an open end of the casing, a spring, and a cam fixedly mounted in the postage meter, and wherein the casing is mounted to the print head, the means for preventing is mounted for slidable movement within the casing between the operative and inoperative positions and to extend through the open end, and the spring biases the means for preventing toward the inoperative position, and wherein the moving means further includes a cam follower connected to the means for preventing which cam follower follows a contour of the cam as the print head moves between the printing and non-printing positions to effectuate movement of the means for preventing into the operative position and to permit movement of the means for preventing into the inoperative position due to biasing of the spring.

* * * * *